US008011138B2

(12) United States Patent
McGonagle et al.

(10) Patent No.: US 8,011,138 B2
(45) Date of Patent: Sep. 6, 2011

(54) PRIVACY BOOTH

(75) Inventors: Patrick McGonagle, Derry (GB); Richard Bell, Crumlin (GB)

(73) Assignee: Pakflatt (UK) Limited, Londonderry (GB)

( * ) Notice: Subject to any disclaimer, the term of this patent is extended or adjusted under 35 U.S.C. 154(b) by 1212 days.

(21) Appl. No.: 11/716,913

(22) Filed: Mar. 12, 2007

(65) Prior Publication Data

US 2007/0227078 A1 Oct. 4, 2007

(30) Foreign Application Priority Data

Mar. 10, 2006 (GB) ..... 0604842.5

(51) Int. Cl.

| | |
|---|---|
| ***A47F 10/00*** | (2006.01) |
| ***E04H 1/00*** | (2006.01) |
| ***E04F 19/00*** | (2006.01) |
| ***E04B 2/74*** | (2006.01) |

(52) U.S. Cl. ..... 52/36.1; 52/27; 52/29; 52/36.4; 52/36.5; 52/36.6

(58) Field of Classification Search ..... 52/36.1, 52/27, 29, 36.4, 36.5, 36.6
See application file for complete search history.

(56) References Cited

U.S. PATENT DOCUMENTS

| | | | | |
|---|---|---|---|---|
| 5,592,787 | A * | 1/1997 | Ophardt | 52/34 |
| 5,967,632 | A * | 10/1999 | Lamia | 312/209 |
| 6,023,896 | A * | 2/2000 | Rothschild | 52/243.1 |
| 6,449,909 | B1 * | 9/2002 | Baloga et al. | 52/36.1 |
| 6,463,701 | B1 * | 10/2002 | Baloga et al. | 52/29 |
| 6,571,519 | B1 * | 6/2003 | Diffrient et al. | 52/239 |
| 6,754,998 | B2 * | 6/2004 | Diffrient et al. | 52/239 |
| 6,817,149 | B2 * | 11/2004 | Diffrient et al. | 52/239 |
| 7,191,565 | B2 * | 3/2007 | Wei Siao | 52/36.4 |
| D599,131 | S * | 9/2009 | Brucker et al. | D6/421 |
| 2002/0023391 | A1 * | 2/2002 | Nymark | 52/36.4 |
| 2002/0026755 | A1 * | 3/2002 | Jones | 52/36.1 |
| 2004/0177573 | A1 * | 9/2004 | Newhouse et al. | 52/239 |
| 2005/0000168 | A1 * | 1/2005 | Wright | 52/36.1 |
| 2005/0016080 | A1 * | 1/2005 | Williams et al. | 52/36.1 |
| 2007/0283630 | A1 * | 12/2007 | Kasdorf et al. | 52/36.1 |
| 2008/0040982 | A1 * | 2/2008 | Durand et al. | 52/36.1 |

FOREIGN PATENT DOCUMENTS

| | | |
|---|---|---|
| GB | 2 212 182 | 7/1989 |

* cited by examiner

*Primary Examiner* — Eileen D Lillis
*Assistant Examiner* — Mark R Wendell
(74) *Attorney, Agent, or Firm* — RatnerPrestia

(57) ABSTRACT

The present invention concerns a privacy booth comprising at least two partition members having first and second terminal ends; and at least two linking members having first and second opposed ends, each second terminal end of the partition member and each first opposed end of the linking members forming a first pivotable coupling, each first terminal end of the partition members and each second opposed end of the linking member forming a second pivotable coupling, the privacy booth being operable between a deployed state, in which adjacent partition members are spaced-apart to define a respective compartment therebetween, and a storage state in which adjacent partition members are substantially parallel with one another, and preferably flat packed against one another.

18 Claims, 9 Drawing Sheets

PRIVACY BOOTH

FIELD OF THE INVENTION

The present invention relates to privacy booths, especially polling or election booths.

BACKGROUND TO THE INVENTION

A privacy booth may only occasionally be required for use. For example, a polling booth is only required during elections. As a result of this, it is desirable that privacy booths be quick and easy to assemble and dismantle, and be easy to store.

Conventional privacy booths tend to comprise separate components such as tables/table tops and screens. Having separate components can increase the time it takes to assemble and dismantle the privacy booths and can also delay, and reduce the efficiency of, transport and storage.

It would be desirable to provide an apparatus that mitigates the problems identified above.

UK Patent 2,212,182 discloses a privacy booth that comprises a plurality of privacy screens mounted together such that the screens can be pivotally moved from a storage position, where the screens are in a side-by-side relationship, to an in use position, where the screens may extend substantially radially away from a common vertical axis. The privacy booth may thus define at least two separate compartments. Each separate compartment may include a tabletop pivoted along a lower edge of a screen. The tabletop may be movable from a storage position substantially parallel with the screen, to an in use position where the tabletop is substantially horizontally disposed between the screens of the compartment.

The privacy booth disclosed in UK Patent 2,212,182 still requires a certain amount of skill and time to assemble and disassemble. It would be desirable to provide an apparatus that could be assembled and disassembled by a person with little or no skill in this field.

SUMMARY OF THE INVENTION

According to a first aspect of the invention there is provided a privacy booth comprising at least two partition members having first and second terminal ends; and at least two linking members having first and second opposed ends, each second terminal end of the partition member and each first opposed end of the linking member forming a first coupling, each first terminal end of the partition member and each second opposed end of the linking member forming a second coupling, the privacy booth being operable between a deployed state, in which adjacent partition members are spaced-apart to define a respective compartment therebetween, and a storage state in which adjacent partition members are substantially parallel with one another, and preferably flat packed against one another.

Preferably the at least two partition members and linking members comprise a plurality of partition members and a plurality of linking members.

Preferably, the first and second couplings comprise first pivotable couplings and second pivotable couplings.

It is preferred that at least three, optionally four, partition members are provided. If four partition members are provided, then the privacy booth will, in its deployed state, define four compartments. The four compartments may be of the same or different sizes or volumes. If the four compartments are of the same size, then, in the deployed state, adjacent pairs of partition members will be at an angle of 90° relative to each other.

Preferably, the first pivotable coupling is a hinge joint. Preferably the second pivotable coupling is a hinge joint. More preferably, each of the first and second pivotable couplings is a hinge joint.

Preferably, each partition member is provided with a spine member at a first edge of the partition member, each spine member being pivotably coupled to at least one adjacent spine member, the privacy booth being operable between a deployed state, in which adjacent partition members are spaced-apart to define a respective compartment therebetween, and a storage state in which adjacent partition members are substantially parallel with one another, and preferably flat packed against one another.

Each spine member may be integral with, or separable from, the respective partition member. In the deployed state, each spine member is, preferably, non-coplanar with its at least one adjacent spine member such that respective adjacent partition members are spaced-apart to define a respective compartment therebetween, and, in the storage state, the spine members are substantially parallel and preferably coplanar such that the respective partition members are substantially parallel with one another, and preferably flat packed against one another. Preferably, in the deployed state, the spine members are disposed edge-to-edge to form a central spine from which the respective partition members radiate. It is preferred that at least three, optionally four, spine members are provided.

The first and second pivotable couplings between adjacent spine members may be provided by means of a linking member comprising a neck having first and second opposed ends, each end being adapted for pivotable engagement with an adjacent spine member. Each spine member may comprise a plate having first and second terminal ends, each end being adapted for pivotable engagement with the linking member. The first and second pivotable coupling of the linking member with respect to adjacent spine members may be provided by a hinge joint comprising a substantially cylindrical member pivotable in a correspondingly shaped socket.

Each spine member may be provided, at the first and second terminal ends, with first and second sockets and each linking member may be provided, at first and second opposed ends, with first and second substantially cylindrical members. Alternatively, each spine member may be provided, at the first and second terminal ends, with first and second substantially cylindrical members and each linking member may be provided, at first and second opposed ends, with first and second sockets. Further alternatively, each spine member may be provided, at the first and second terminal ends, with either a first socket and a second substantially cylindrical member or a first substantially cylindrical member and a second socket and each linking member may be provided, at the first and second opposed ends, with either a first substantially cylindrical member and a second socket or a first socket and a second substantially cylindrical member, respectively.

The first and second pivotable couplings between adjacent spine members may be by means of a female connector provided on each spine member (preferably at terminal ends of each spine member) and a corresponding linking member having male connectors (preferably at opposed ends of each linking member) pivotable with respect to the female connectors on adjacent spine members. The female connector may define an elongated partial torus-shaped space, to accommodate, in use, a correspondingly shaped and dimensioned substantially cylindrical member. Alternatively, the pivotable coupling between adjacent spine members may be by means of a male connector provided on each spine member (preferably at terminal ends of each spine member) and a corresponding linking member having female connectors engageable with the male connectors on adjacent spine members. Further alternatively, the pivotable coupling between adjacent spine members may be by means of a male connector provided at one end of the spine member and a female connector provided at the other end of the spine member (or vice versa) and the linking member has corresponding female and male connectors engageable with the male and female connectors of adjacent spine members, respectively. In the preferred embodiment, a female connector is provided at terminal ends of each spine member and the linking member has a correspondingly shaped and dimensioned male connector for each female connector. Advantageously, the male and female connectors are pivotable with respect to one another when engaged. Typically, adjacent spine members are pivotable about a respective in use vertical axis.

The coupling between at least one pair of adjacent spine members is removable or disengageable to allow the booth to be assembled or disassembled. Alternatively, said coupling may be omitted.

Preferably, the first and second terminal ends of each spine member are provided with first and second sockets, respectively, each defining a substantially cylindrical space, the respective volumes of which may be the same or different. The first socket is provided with a first mouth whose arcuate length is such as to allow the neck of the linking member to pivot between the storage state and the deployed state. An abutment is provided on the first socket adjacent the first mouth. The second socket is provided with a second mouth whose arcuate length is such as to allow the neck of the linking member to pivot between the storage state and the deployed state. The second socket is provided with a lip adjacent the second mouth and a flange extending from the second socket in a direction away from the second mouth.

In the preferred embodiment, the abutments take the form of one or more lips or flanges provided on the respective female connectors. Preferably, the abutment of the first socket is arranged to engage with the lip of the second socket of the adjacent spine member, when the booth is in the deployed state. Hence, the abutments prevent adjacent spine members from pivoting beyond the deployed state from the storage state.

Preferably, the flange of the second socket is arranged to engage against the adjacent partition member, when the booth is in the storage state. Hence, the flange prevents adjacent spine members from pivoting beyond the storage state from the deployed state.

A respective post or frame member may be provided at a second edge of each partition member, distal the first edge and the respective spine member. In use, the frame members are preferably ground-engaging and support the partition members above the ground. A respective extendable leg may be provided at each frame member. Each frame member may be at least partially hollow and the respective leg may be telescopically mounted therein.

A respective panel may be provided for each compartment, each panel being movable between a storage state, in which it is substantially parallel with, and preferably flat packed against, a respective partition member, and a deployed state in which it extends between adjacent partition members, advantageously to provide a substantially horizontal surface during use.

Preferably, a first edge of the panel is pivotably connectable to a first partition member and a second edge of the panel is provided with a shaped hook and the second, adjacent partition member includes means for supporting the shaped hook. When the privacy booth comprises four partition members, the panel is typically substantially triangular or defines a quadrant in shape (plan view).

In preferred embodiments, a respective panel support member is provided in each partition member, the panel support member having first and second faces on each side of the partition member, wherein one of said exposed portions includes means for supporting said second edge of the panel, the other of said exposed portions including means for pivotably coupling said first edge of the panel to the partition member. Each panel support member may conveniently be inserted between two separate portions of a respective partition member and, typically, is substantially horizontally disposed in use.

In typical embodiments, the partition members may be any shape provided they comprise at least one substantially straight edge which may be coupled to a respective spine member. Alternatively, in typical embodiments, the partition members may be any shape provided they, when coupled to a respective spine member, define, in use, adjacent each terminal end, a substantially vertical pivot axis. More preferably, the partition members define, when coupled to a respective spine member, in use, a pair of substantially parallel, spaced-apart, substantially vertical pivot axes. Even more preferably, each substantially vertical pivot axis is provided at the generatrix of a substantially circular cylindrical socket. Optionally, each substantially circular cylindrical socket defines a right cylindrical socket. A respective partition member may be at least partially bordered by a frame.

Typically, a panel may be any shape provided it has at least two substantially straight edges which may be attachable to adjacent partition members in a deployed state. Preferably a securing means may be provided to secure the panel in both a stored position and a deployed position.

The privacy booth may be elevated above ground level by the provision of the legs. The legs may, for example, be telescopic. Securing means may be provided to secure a respective leg in a retracted position, an extended position or at varying heights. The legs may be provided with, for example, non-slip feet or wheels. Optionally these may be removable.

Preferably, securing means may be provided to secure the privacy booth in a stored state and an in use deployed state.

A second aspect of the invention provides a privacy booth comprising a plurality of partition members, the booth being operable between a deployed state, in which adjacent partition members are spaced-apart to define a respective compartment therebetween, and a storage state in which the partition members are substantially parallel with one another, and preferably flat packed against one another, wherein a respective panel is provided for each compartment, each panel being movable between a storage state, in which it is substantially parallel with, and preferably flat packed against, a respective partition member, and a deployed state in which is extends between adjacent partition members, advantageously to provide a substantially horizontal surface during use.

Preferably, a first edge of the panel is pivotably connectable to a first partition member and a second, adjacent partition member includes means for supporting a second, adjacent edge of the panel. The panel is typically substantially triangular or a quadrant in shape.

In preferred embodiments, a respective panel support member is provided in each partition member, a respective face or portion of each panel support member being exposed on each side or face of the partition member, wherein one of said exposed portions includes means for supporting said second edge of the panel, the other of said exposed portions including means for pivotably coupling said first edge of the panel to the partition member. Each panel support member may conveniently be inserted between two separate portions of a respective partition member and, typically, is substantially horizontally disposed in use.

In typical embodiments, the partition members may be any shape provided they comprise at least one substantially straight edge which may be coupled to a respective spine member. A respective partition member may be at least partially bordered by a frame.

Typically, a panel may be any shape provided it has at least two substantially straight edges which may be attachable to adjacent partition members in a deployed state. Preferably a securing means may be provided to secure the panel in both a stored position and a deployed position.

According to a third aspect of the invention there is provided a privacy booth comprising a plurality of partition members; and a spine member is provided at a first edge of each partition member, each spine member being pivotably coupled to at least one adjacent spine member, the privacy booth being operable between a deployed state, in which adjacent partition members are spaced-apart to define a respective compartment therebetween, and a storage state in which adjacent partition members are substantially parallel with one another, and preferably flat packed against one another.

The advantages of the present invention include: the privacy booth is relatively simple to manufacture; it is easier and faster to assemble and disassemble as required; it is relatively secure during use; and it is easy to store and transport in its disassembled "flat pack" state.

Further advantageous aspects of the invention will become apparent to those ordinarily skilled in the art upon review of the following description of a specific embodiment and with reference to the accompanying drawings.

BRIEF DESCRIPTION OF THE DRAWINGS

An embodiment of the invention is now described by way of example and with reference to the accompanying drawings in which like numerals are used to indicate like parts and in which.

DETAILED DESCRIPTION OF THE INVENTION

Figure 1:
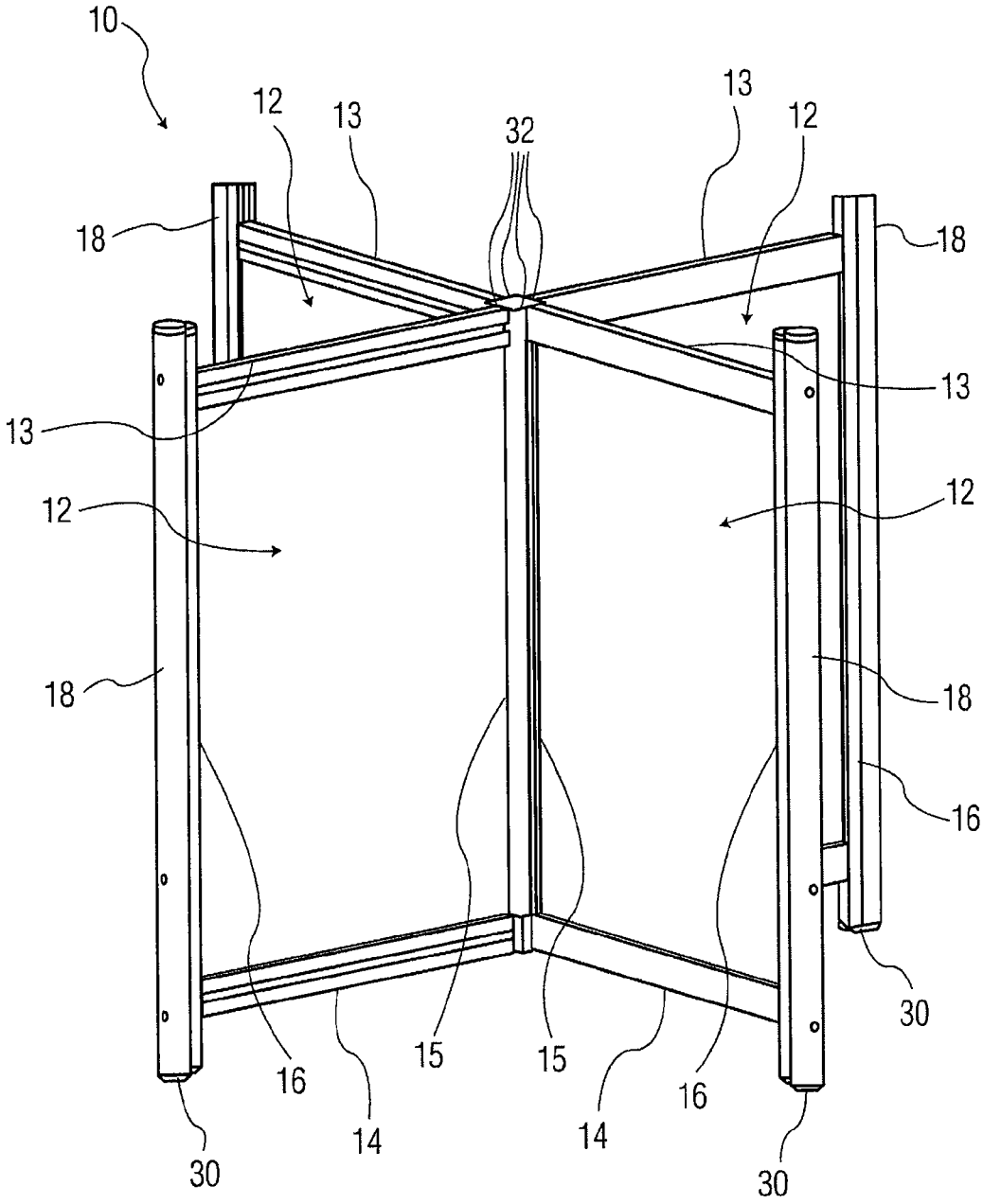
FIG. 1 shows a perspective view of a deployed privacy booth, embodying a first aspect of the invention.

Referring now to FIG. 1 of the drawings, there is shown, generally indicated as 10, a privacy booth embodying the first and third aspects of the invention. The privacy booth 10 comprises two or more partition members 12. In the illustrated embodiment, the privacy booth 10 comprises four partition members 12. The partition members 12 may, in use, define a plurality of private compartments. Each partition member 12, as shown in FIG. 1, comprises a panel which may for example be substantially rectangular in shape which, in use, has substantially horizontal upper and lower edges, 13, 14 and substantially vertical inner and outer side edges (or first and second edges) 15, 16. The partition members 12 may be manufactured from translucent material or, more preferably, from opaque material. As a result of this, the activities of a user within a compartment may be concealed from other users in neighbouring compartments.

Figure 2:
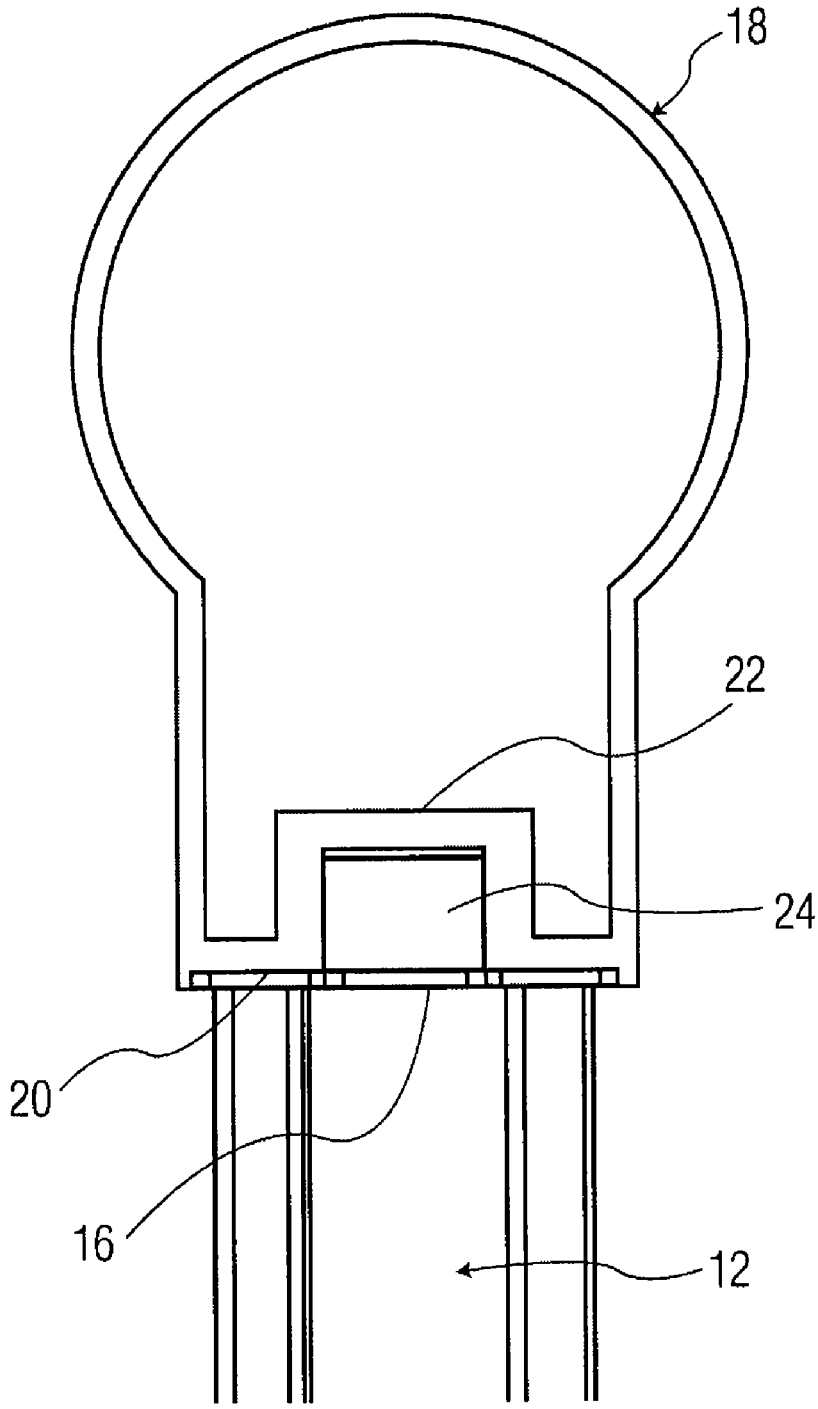
FIG. 2 shows a transverse sectioned view of a tubular frame attached to a partition member, included in the booth of FIG. 1.

The outer edge 16 of each partition member 12 is attachable to a post or frame member 18. The frame members 18 may, in use, support the privacy booth 10 in a substantially vertical and upright position. Referring to FIGS. 1 and 2, each frame member 18 may comprise an elongated tube, preferably having a keyhole shaped transverse cross-section. Each respective frame member 18 may be connectable to the outer edge 16 of a respective partition member 12 by, for example, male and female inter-engagement means. For example, as shown in FIG. 2, the internal face 20 of the frame member 18 may be shaped to define a groove 22. The groove 22 may run substantially parallel with the longitudinal axis of the frame member 18. The groove 22 may be shaped and dimensioned to receive a projection 24 located on the outer edge 16 of the partition member 12. It will be appreciated that the reverse orientation is also envisaged. Each frame member 18 is preferably at least substantially equal in length to a partition member 12. In FIG. 1, the frames 18 are slightly longer than the length of the partition members 12. This allows the privacy booth 10 to be supported, in use, on a ground-engaging end of the frame member 18. The ground-engaging end of the frame member 18 may be provided with a respective foot 30. The frame member 18 may also comprise legs (not shown). A respective leg may extend from the ground-engaging end of a respective frame member 18 in a direction substantially coincident with or parallel with the longitudinal axis of the respective frame member 18. Each leg is preferably extendable (e.g. telescopically into and out of its frame member 18) amongst a plurality of deployed states, and may be secured in each deployed state. The privacy booth 10 may therefore be elevated to a desired height.

Figure 3:
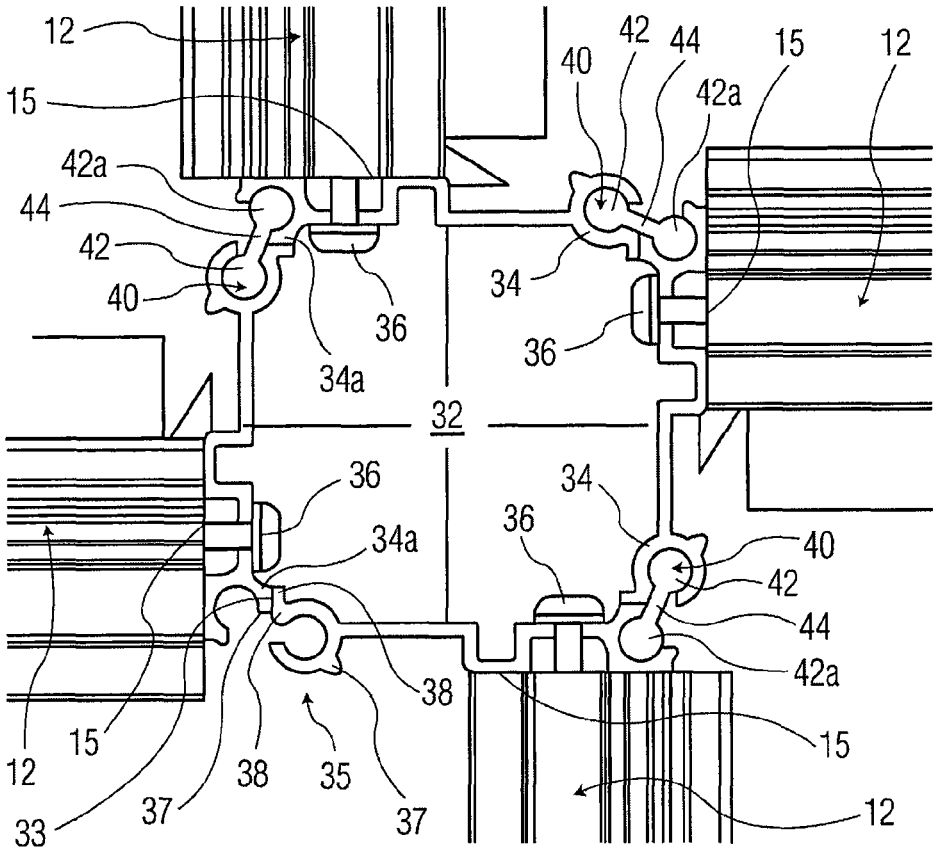
FIG. 3 shows a partial transverse sectioned view of four partition members attached to four spine members, included in the booth of FIG. 1, in a deployed state.
Figure 3A:
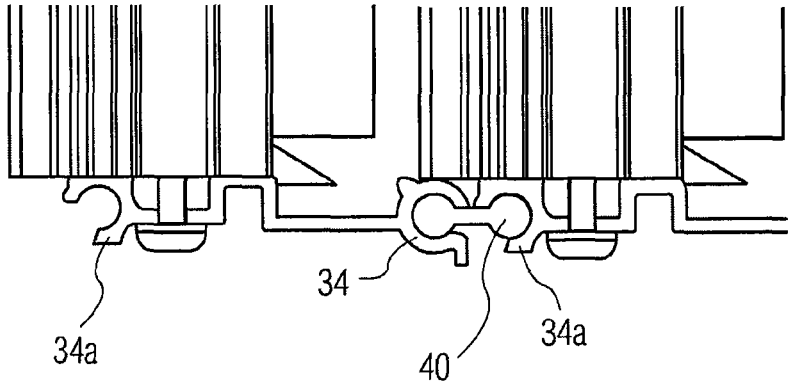
FIG. 3A shows a partial transverse sectioned view of two partition members attached to two spine members, included in the booth of FIG. 1, in a storage state.

The inner edge 15 of each partition member 12 is attachable to a respective spine member 32. The spine members 32, in use, hold the partition members 12 in a substantially vertical and upright position. Referring to FIGS. 1, 3 and 3A, each spine member 32 may comprise an elongated plate having, in use, substantially horizontal upper and lower edges and substantially vertical first and second side edges or ends. One or more respective male or female connector(s) are provided at each side edge. In the preferred embodiment, each side edge is provided with a female connector in the form of first and second sockets 34, 34*a*. The sockets 34, 34*a* or other connector, extends wholly or partially along the, in-use, vertical length of the spine member 32. In alternative embodiments, two or more first and second sockets, or other connectors, may be provided, spaced-apart along the length of the spine member 32. Each first and second socket 34, 34*a* may be substantially C-shaped and the mouth of each socket 34, 34*a* may face substantially away from each other and from the plate of the spine member 32.

The inner edge 15 of a respective partition member 12 is connectable to an outer face of a respective spine member 32, for example by means of screws 36 or other fixing means. A respective screw 36 may be locatable through an aperture (not shown) in the spine member 12 and engage with the inner edge 15 of the partition member 12. Each partition member 12 is preferably secured substantially perpendicularly to the outer face of the spine member 32.

As shown in FIGS. 3 and 3A, each spine member 32 is connectable to at least one adjacent spine member 32. In the preferred embodiment, adjacent spine members 32 are connectable at their respective side edges. To this end, a linking member 40 may be provided that is co-operable with the sockets 34, 34*a* provided on the spine members 32. In the present example, the linking member 40 is a pair of male connectors shaped and dimensioned for pivotable engagement within the sockets 34, 34*a*. Alternatively, the linking member may comprise two inter-engageable male connectors, each of which is shaped and dimensioned for pivotable engagement within one of the sockets 34, 34*a*. One or more linking members 40 may be provided for each coupling between adjacent spine members 32. The linking members 40 may be dimensioned to extend wholly or partially along the length of the edge of the spine member, and preferably may be removably insertable into the sockets 34, 34*a*. In FIG. 3, the junction 35 between adjacent spine members 32 is shown without a linking member 40 and this allows the booth 10 to be changed from/to into its storage state. Each linking member 40 may comprise a rod with a dumbbell shaped transverse cross-section, i.e. circular cylinder-like or rounded ends 42 with a narrow interconnecting neck 44. In use, one end 42 of a respective linking member 40 engages with the socket 34 of a spine member 32 while the opposite end 42*a* of the linking member 40 engages with the socket 34 of an adjacent spine member 32.

When engaged, the sockets 34, 34*a* and the linking member ends 42, 42*a* may pivot or move with respect to one another, especially about at least one in-use vertical axis. The amount of movement is limited by the size of the mouth of a respective socket 34, 34*a* and the size of the neck 44 of a respective coupled linking member 40. Two adjacent spine members 32, when coupled by a linking member 40, are therefore both separately pivotable about each end of the linking member 40. The two adjacent spine members 32 may therefore have a range of movement relative to each other. The spine members 32 may be movable, for example, from an arrangement shown in FIG. 3, where the spine members 32 are substantially perpendicular with one another, to an arrangement shown in FIG. 3A where the spine members 32 are substantially coplanar, such that the partition members 12 may be flat packed or stacked on one another.

Each spine member 32 includes at least one abutment at each side edge for abutting with a corresponding abutment on an adjacent spine member 32 when the spine members 32 are coupled together. The arrangement is such that, when adjacent spine members 32 are in a normal use state, in which they may be substantially perpendicularly disposed, as illustrated, their respective abutments abut to prevent the spines 32 from pivoting with respect to one another in one rotational direction about an in use vertical axis. In particular, the abutments prevent the spine members 32 from pivoting from the normal deployed state in a manner that would decrease the smallest angle formed between them. Each spine member 32 includes an abutment 33 adjacent the first mouth. Each spine member 33*a* includes a lip 38 adjacent the second mouth. The arrangement is such that, when adjacent spine members 32 are in a fully deployed state, in which they may be substantially perpendicularly disposed, as illustrated, the abutment 33 engages against the lip 38, to prevent the spine members 32 from pivoting with respect to one another in one rotational direction about an in use vertical axis.

The abutments are conveniently provided on the sockets 34, 34*a*, for example, as a lip 38 adjacent the second mouth of the socket 34*a* and as an abutment 33 on the first socket 34 adjacent the first mouth. In the preferred embodiment, therefore, the socket 34 is shaped to abut against the socket 34*a* of an adjacent spine member 32 in order to prevent the adjacent spine members 32 from being pivoted in a first direction beyond a normal use state (in which the spine members 32 are typically substantially perpendicular with one another, i.e. an angle of approximately 90° is formed between their respective inner faces), but to allow relative pivoting of the spine members 32 in an opposite direction so that the spines 32 may adopt a storage state (in which the spine members 32 are, preferably, substantially coplanar with one another). In the fully deployed state, the lip 38 abuts against the abutment 33. It is preferred that the first socket 34 have a wider first mouth than the second mouth of the second socket 34*a*. The second socket 34*a* is also provided with a flange 37, adjacent to which the second socket engages against an adjacent partition member, as is illustrated in FIG. 3A.

Figure 4:
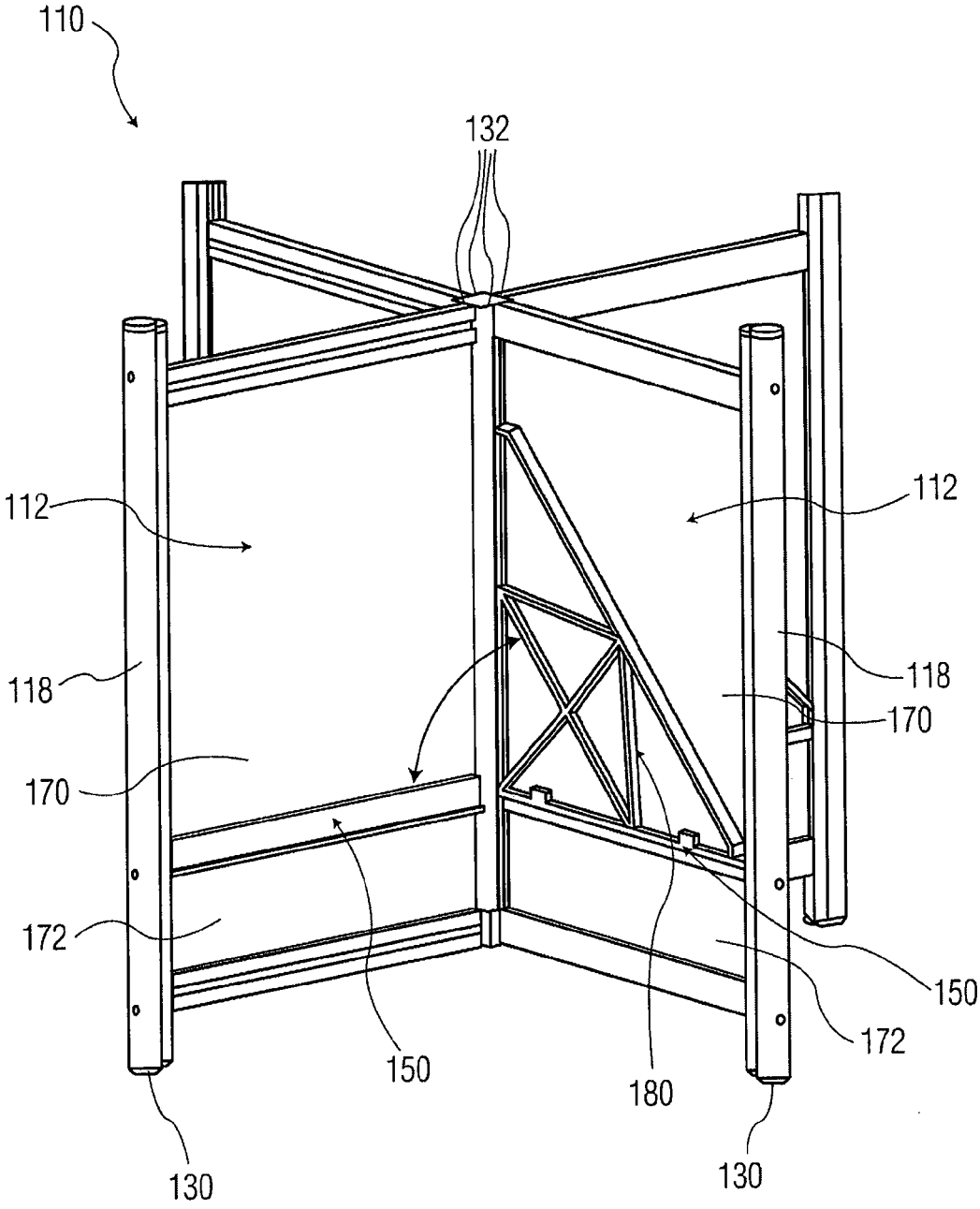
FIG. 4 shows a perspective view of a partially deployed privacy booth, embodying first and second aspects of the invention.

Referring now to FIG. 4, a privacy booth 110 is shown embodying a second aspect of the invention. The privacy booth 110 is similar to the privacy booth 10 and similar numerals are used to indicate like parts. The booth 110 is characterised by the provision of a panel 180 which is deployable between a storage state (shown in FIG. 4) and a deployed state (FIG. 8) in which it may serve as a tabletop. Co-operable with the panel 180 is a support member or moulding 150. The moulding 150 provides means of attaching the panel 180 to a partition member 112. The moulding 150, which is detailed in FIG. 5, has a front face 151 and a rear face 153. A recess 152, which is preferably curved in cross section, is formed in the rear face 153. The recess 152 may run parallel with the longitudinal axis of the moulding 150. In addition, the front face 151 may be provided with a hooked flange 154. The hooked flange 154 may also run parallel with the longitudinal axis of the moulding 150. One end of each moulding 150 is attachable to the face 120 of a respective frame member 118. The opposite end of the moulding 150 is attachable to a face of a respective spine member 132. The ends of the moulding 150 are attachable to the frame members 118 and spine member 132 by respective attachment pieces 156. Each attachment piece 156, detailed in FIG. 6, may comprise a plate 158, having a collar 160 which may extend perpendicularly from the face of the plate 158. The cross-section of the collar 160 is advantageously shaped substantially similarly to the cross-sectional shape of the moulding 150. The size of collar 160 however is smaller than the cross-section of the moulding 150 so that the collar 160 may fit within the moulding 150. The plate 158 is attachable to the face 20 of a respective frame member 118. A further attachment piece 156 is similarly attachable to a face of a respective spine member 132. The attachment pieces 156 are attachable by screws 162 or any other convenient fixing means. In use, each moulding 150 is slotted over the respective collars 160 of the attachment pieces 156 and is thus secured to the frame 118 and spine member 132. In this state the open ends of the moulding 150 typically abut against the respective plates 158 of the attachment pieces 156. Hence, the attachment pieces 116 serve as male connectors whereas the ends of the moulding 150 serve as female connectors. It will be apparent that this arrangement may be reversed.

Figure 5:
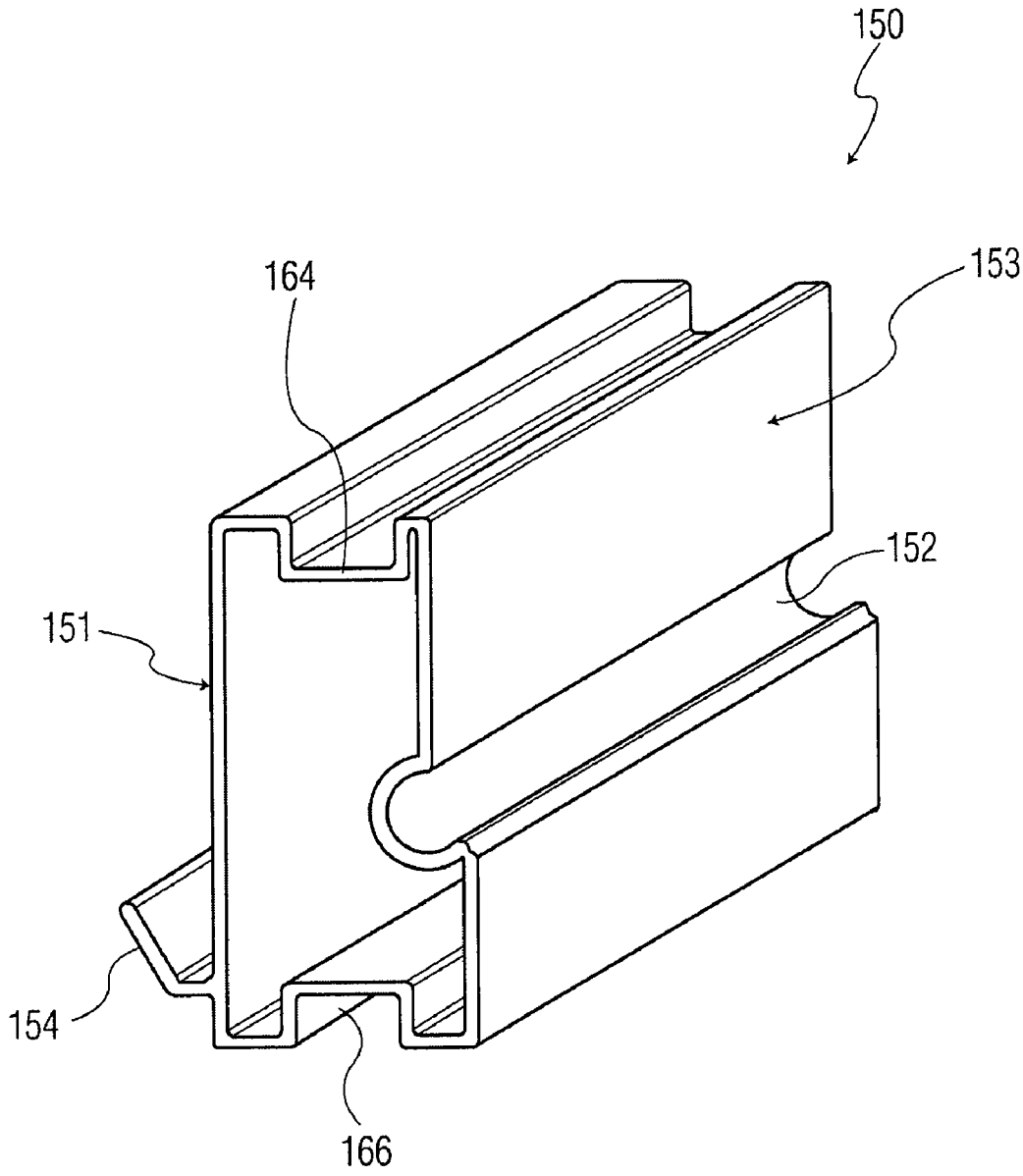
FIG. 5 shows a perspective view of a moulding suitable for use in booths embodying the invention.
Figure 6:
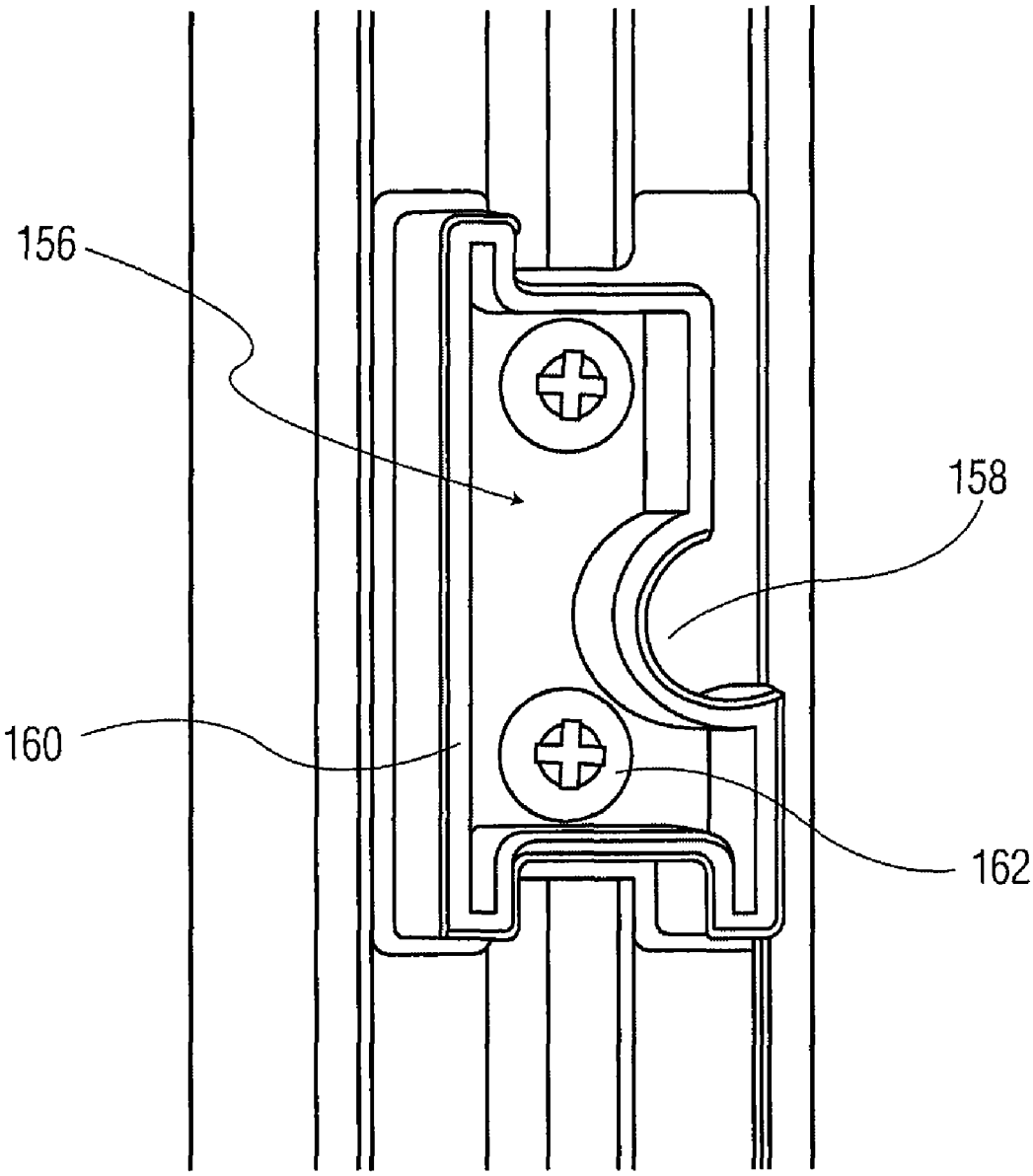
FIG. 6 shows a perspective view of a moulding attachment piece.
Figure 7:
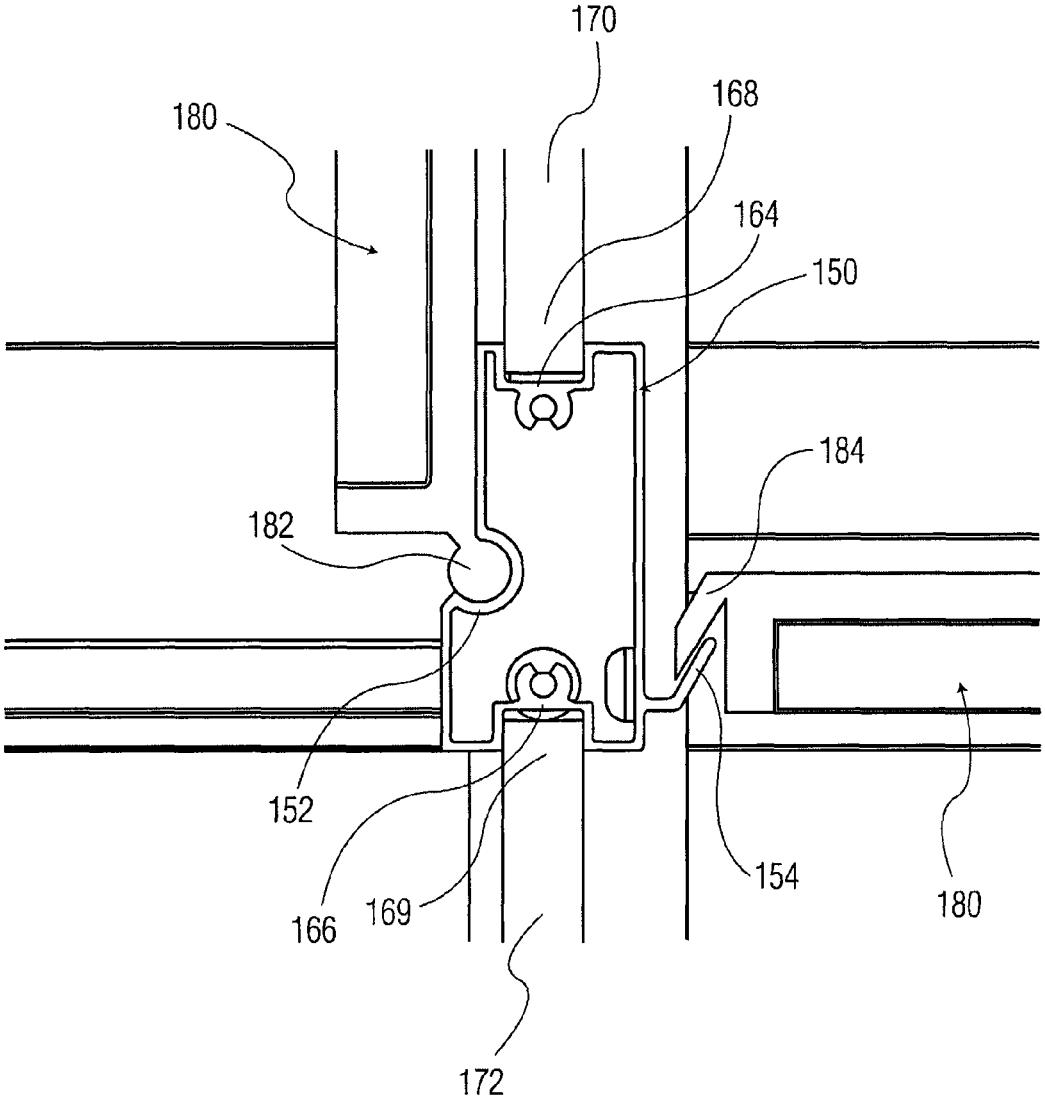
FIG. 7 shows a partial vertical sectioned view of a partition member and moulding, and illustrates the coupling of a panel to the moulding, in which one panel is substantially vertical and another panel is substantially horizontal.
Figure 8:
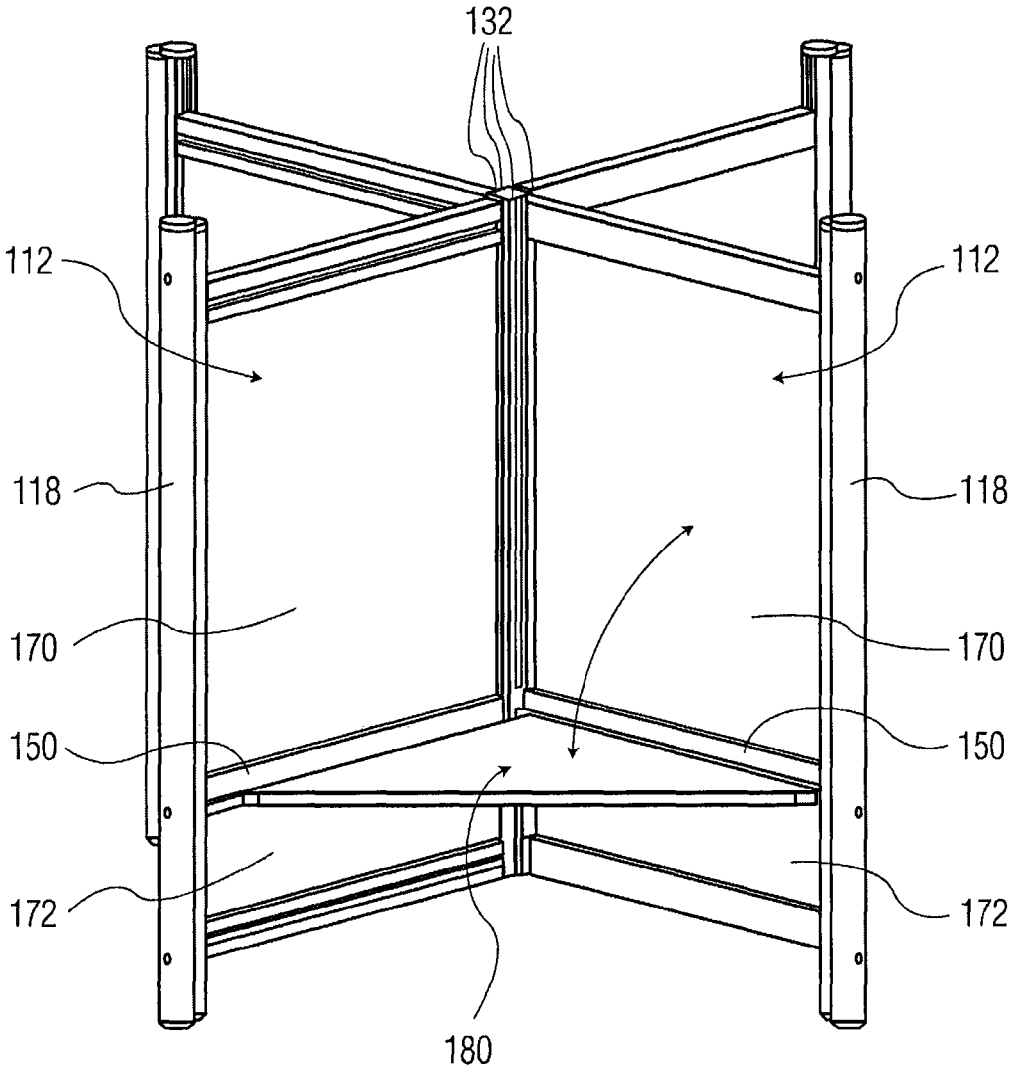
FIG. 8 shows a perspective view of a deployed privacy booth, embodying first and second aspects of the invention.

Referring to FIGS. 4 and 8, in the preferred embodiment, the partition members 112 are provided as separate upper and lower partition members 170, 172. The moulding 150 is fitted between the upper and lower partition members 170, 172. The upper and lower partition members 170, 172 may be coupled to the moulding 150 by a male and female inter-engagement means. For example, as shown in FIG. 5, the moulding 150 may comprise upper and lower grooves 164, 166. The upper and lower grooves 164, 166 may run parallel with the longitudinal axis of the moulding. These upper and lower grooves 164, 166 may be shaped and dimensioned to receive a respective projection 168, 169 (shown in FIG. 7) on the upper and lower partition members 170, 172. It will be appreciated that the reverse orientation is also envisaged. As a result of this, the curved recess 152 and hooked flange 154 of a respective moulding 150 may be exposed on opposite faces of a respective partition member 112.

Figure 7A:
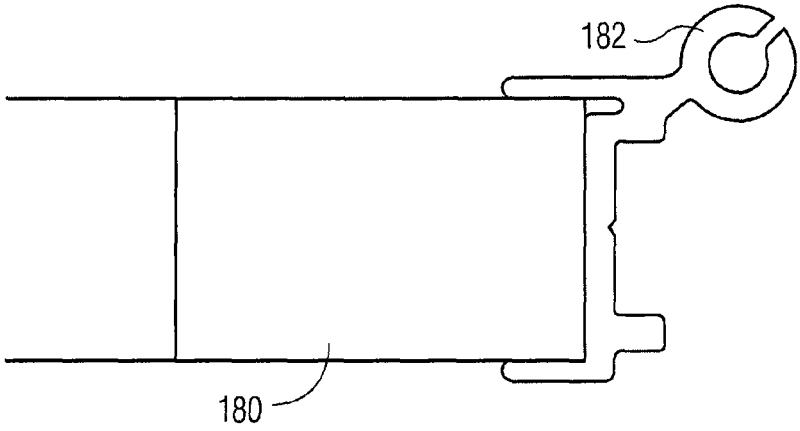
FIG. 7A shows a partial sectioned view of an alternative means of attaching a panel to the moulding of FIG. 5.
Figure 7B:
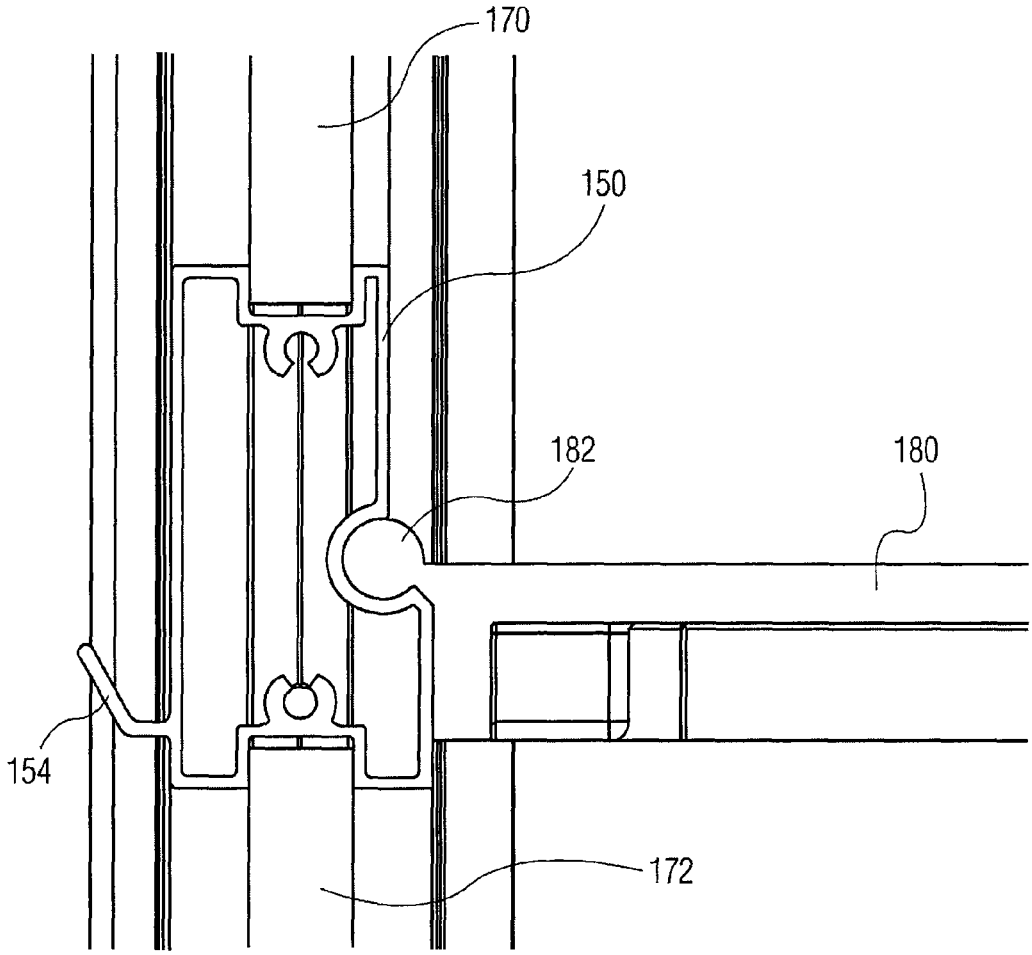
FIG. 7B shows a partial vertical sectioned view of a partition member and moulding, and illustrates the coupling of a panel to the moulding, in which one panel is substantially horizontal.

Referring to FIGS. 4, 7, 7B and 8, each panel 180 (a respective panel typically being provided for each compartment) is connectable to a respective moulding 150 and in particular to the exposed rear face 153. Each panel 180 has a pivotable male connector 182 which may engage with the curved recess 152 of the respective moulding 150. In this embodiment, the male connector 182 is integral with the panel 180. Alternatively, as is illustrated in FIG. 7A, the male connector 182 is formed separately from the panel 180 and is push fitted against the panel 180. The panel 180 may thus pivot relative to the moulding 150 between its storage and deployed states. In the stored position, the panel 180 is substantially parallel with the partition member 112, while in the deployed position the panel 180 is substantially horizontally disposed. When deployed, an edge of the panel 180 may engage with the hooked flange 154 of an adjacent moulding 150. To this end the edge of the panel 180 may comprise an oppositely shaped hook 184 that clips onto the hooked flange 154.

The invention therefore provides a privacy booth 110 that may be deployed, as shown in FIGS. 4 and 8, when required for use. The privacy booth 110 provides a plurality of private compartments defined by partition members 112. In the embodiment shown in FIGS. 4 and 8, four partition members 112 are used to define four compartments however the privacy booth 110 may define any number of compartments.

When not required for use, the privacy booth 10, 110 may be compacted (not shown): the panels 180 may be placed in their stored position; the legs (not shown) may be stored i.e. retracted into their respective frames 18, 118 and the spine members 32, 132 may be arranged, substantially parallel such that the partition members 12, 112 are 'flat packed'. In the compacted state, the privacy booth 10, 110 is easy to store and transport.

The present invention is not limited to the embodiment(s) described herein, which may be amended or modified without departing from the scope of the present invention.

The invention claimed is:

1. A privacy booth comprising:

a. at least two partition members, each partition member having an inner edge and an outer edge; and b. at least two linking members, each linking member comprising a neck having first and second opposing ends, each end of the neck being adapted for pivotable engagement with one of the partition members;

wherein the inner edge of one of the partition members and the first end of one of the linking members form a first coupling, and the inner edge of an adjacent one of the partition members and the second end of the one linking member form a second coupling; such that the privacy booth is operable between a deployed state, in which the one partition member and the adjacent partition member are spaced-apart to define a respective compartment therebetween, and a storage state in which the one partition member and the adjacent partition member are substantially parallel with one another.

2. The privacy booth of claim 1, in which the first and second couplings are first and second pivotable couplings.

3. The privacy booth of claim 2, in which the first pivotable coupling is a hinge joint.

4. The privacy booth of claim 2, in which the second pivotable coupling is a hinge joint.

5. The privacy booth of claim 2, in which each of the first and second pivotable couplings is a hinge joint.

6. The privacy booth of claim 2, in which the first and second pivotable couplings each comprise a substantially cylindrical member pivotable in a correspondingly shaped socket.

7. The privacy booth of claim 1, in which each partition member defines, in use, a pair of substantially parallel, spaced-apart, substantially vertical pivot axes.

8. The privacy booth of claim 1, in which each partition member is provided with a spine member at the inner edge of the partition member; wherein each spine member is pivotably coupled to at least one adjacent spine member.

9. The privacy booth of claim 8, in which each partition member defines, when coupled to a respective spine member, in use, a pair of substantially parallel, spaced-apart, substantially vertical pivot axes.

10. The privacy booth of claim 8, in which each end of the neck is adapted for pivotable engagement with an adjacent spine member.

11. The privacy booth of claim 10, in which each linking member defines, in use, a pair of substantially parallel, spaced-apart, substantially vertical pivot axes.

12. The privacy booth of claim 8 in which each spine member comprises first and second sockets and each linking member comprises first and second substantially cylindrical members.

13. The privacy booth of claim 12, in which the first and second sockets each define a substantially cylindrical space, the respective volumes of which may be the same or different.

14. The privacy booth of claim 12, in which the first socket is provided with a first mouth whose arcuate length is such as to allow the neck of the linking member to pivot between the storage state and the deployed state; and the second socket is provided with a second mouth whose arcuate length is such as to allow the neck of the linking member to pivot between the storage state and the deployed state.

15. The privacy booth of claim 14, in which the first socket comprises an abutment adjacent the first mouth and the second socket comprises a lip adjacent the second mouth, wherein the abutment of the first socket of a some member is arranged to engage with the lip of the second socket of an adjacent spine member, when the booth is in the deployed state.

16. The privacy booth of claim 1, in which the first and second couplings each comprise a substantially cylindrical member pivotable in a correspondingly shaped socket.

17. The privacy booth of claim 1, wherein each compartment defined between adjacent partition members further comprises a respective panel, each panel being movable between a storage state, in which it is substantially parallel with a respective partition member, and a deployed state in which it extends between adjacent partition members.

18. The privacy booth of claim 17, in which a first edge of the panel is pivotably connectable to a first partition member and a second edge of the panel is provided with a shaped hook; and the second, adjacent partition member includes means for supporting the shaped hook.

* * * * *